United States Patent [19]

McCormick

[11] 4,286,668

[45] Sep. 1, 1981

[54] SPRINKLER SYSTEM CONTROL VALVE AND ACTUATOR DEVICE

[76] Inventor: Derek McCormick, 73 Station St., Misterton, Doncaster, South Yorkshire, England

[21] Appl. No.: 25,075

[22] Filed: Mar. 29, 1979

[51] Int. Cl.[3] ..... A62C 37/06

[52] U.S. Cl. ..... 169/22; 251/45; 137/505

[58] Field of Search ..... 169/19, 20, 22, 37, 169/90, 40; 251/43, 44, 45; 137/413, 102, 512.2, 512.3, 869, 505

[56] References Cited

U.S. PATENT DOCUMENTS

| | | | |
|---|---|---|---|
| 656,837 | 8/1900 | Derby | 169/20 |
| 1,209,797 | 12/1916 | Anderson | 169/20 |
| 1,615,056 | 1/1927 | Tyden | 169/22 |
| 2,072,634 | 3/1937 | Griffith et al. | 169/22 |
| 3,702,160 | 11/1972 | Grenier | 169/20 |

*Primary Examiner*—Robert J. Spar
*Assistant Examiner*—Kenneth Noland
*Attorney, Agent, or Firm*—Thomas J. Greer, Jr.

[57] ABSTRACT

A sprinkler system control valve has a "wet" valve which is maintained seated against a mains water inlet by water pressure applied to a piston of larger effective area than the wet valve. The sprinkler system downstream of the wet valve is charged with air at a relatively low pressure, this air pressure also being supplied to an actuator chamber so as to maintain a deadweight in a lifted position. Upon operation of a sprinkler head the air pressure in the system drops rapidly, causing the deadweight to descend, operating a trip valve through a self-locking cam. Once operated, the trip valve vents the pressure on the piston to an exhaust port allowing the wet valve to open, and at the same time cutting off the actuator chamber from the sprinkler system by the entry of a sealing O-ring into an internal bore in the wet valve housing.

6 Claims, 2 Drawing Figures

SPRINKLER SYSTEM CONTROL VALVE AND ACTUATOR DEVICE

DESCRIPTION

Figure 1:
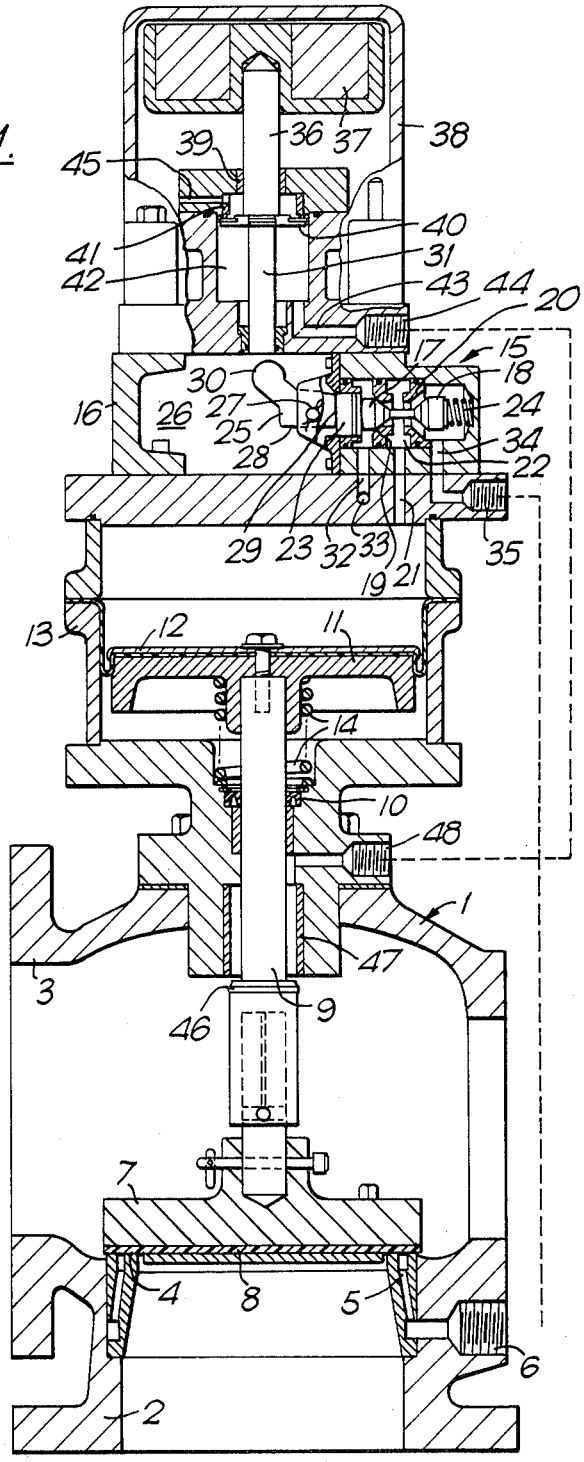

This invention relates to a control valve and actuator device for a fire protection sprinkler system.

A fire protection sprinkler installation consists of a system of overhead pipes fitted with sprinkler heads which incorporate normally closed valves. The sprinkler head valves are normally heat-sensitive and open automatically when a fire is detected discharging water under pressure through a spray nozzle or nozzles onto the seat of the fire.

A known type of control valve and actuator device has a so called "wet valve" in the form of a valve clapper which is either maintained in contact with a valve seat by water under pressure in the pipe system connected to the sprinkler heads (a "wet-pipe" system) or is maintained closed against its valve seat by a differential air pressure acting on the wet valve (a "dry-pipe" system). Typically, if the water mains pressure supplied to the wet valve is 150 psi the air pressure required in a dry-pipe system to maintain the control valve closed would be approximately 40 psi.

A problem associated with the operation of dry-pipe systems of the type referred to above is that of exhausting the air in the system when the control valve opens: an exhauster device may have to be fitted to the main sprinkler pipe work close to the control valve to provide an adequate air escape vent so as to ensure rapid reduction of the air pressure in the system and minimise the delay in water reaching the sprinkler heads from the control valve.

An object of the present invention is to provide a sprinkler system control valve and actuator device which is capable of operating as part of a wet-pipe or dry-pipe system, and which is maintained in a closed condition by water pressure, whether operating as a dry-pipe or wet-pipe system.

According to the present invention there is provided a control valve and actuator device for a sprinkler system, comprising a water supply valve having a housing provided with a water inlet, a water outlet and a valve seat with which a movable valve member cooperates, a valve actuator attached to the valve housing and operable by the water inlet pressure to maintain the valve member sealed against the valve seat, and a trip valve operable in response to a pneumatic signal pressure to vent the water pressure from the actuator so as to allow the valve member to lift from the valve seat under the influence of the water pressure.

Since the water supply valve (the "wet valve") is maintained shut by the water supply pressure acting upon the valve actuator without recourse to a differential air pressure device, it is possible to operate the valve by means of a relatively low signal pressure. When the valve and actuator device is used in a dry-pipe sprinkler system it is not, therefore, necessary to employ an exhauster for rapid reduction of the air pressure when the water supply valve is opened.

The valve actuator may comprise a piston movable within and sealed relative to a cylinder, the piston having an effective surface area greater than the effective area of the valve member subjected to the water pressure when the valve member is sealed against its valve seat, thereby maintaining the water supply valve closed.

The actuator piston may be sealed relative to the walls of the cylinder by a rolling diaphragm, providing a leak-free seal between the piston and the cylinder, while allowing unimpeded movement of the piston even after a long period of inactivity.

The trip valve is preferably operable by a trip mechanism under the action of a deadweight opposed by the air pressure at the water outlet of the supply valve when the latter is closed, the said air pressure dropping in response to the operation of a sprinkler head sufficiently to cause the deadweight to operate the trip valve by means of the trip mechanism so as to cut off the water inlet pressure from the actuator and connect the actuator to a water drain or exhaust outlet.

The trip mechanism may comprise a cam cooperating with the trip valve and having first and second stable positions, the cam being movable from the first stable position, in which the trip valve closes the drain or exhaust outlet and connects the actuator to the water inlet pressure, to the second stable position, in which the trip valve opens the drain or exhaust outlet and cuts off the water inlet pressure from the actuator, by an operating lever or arm which is engaged by a displaceable operating member moved by the deadweight upon said dropping of the air pressure.

Figure 2:
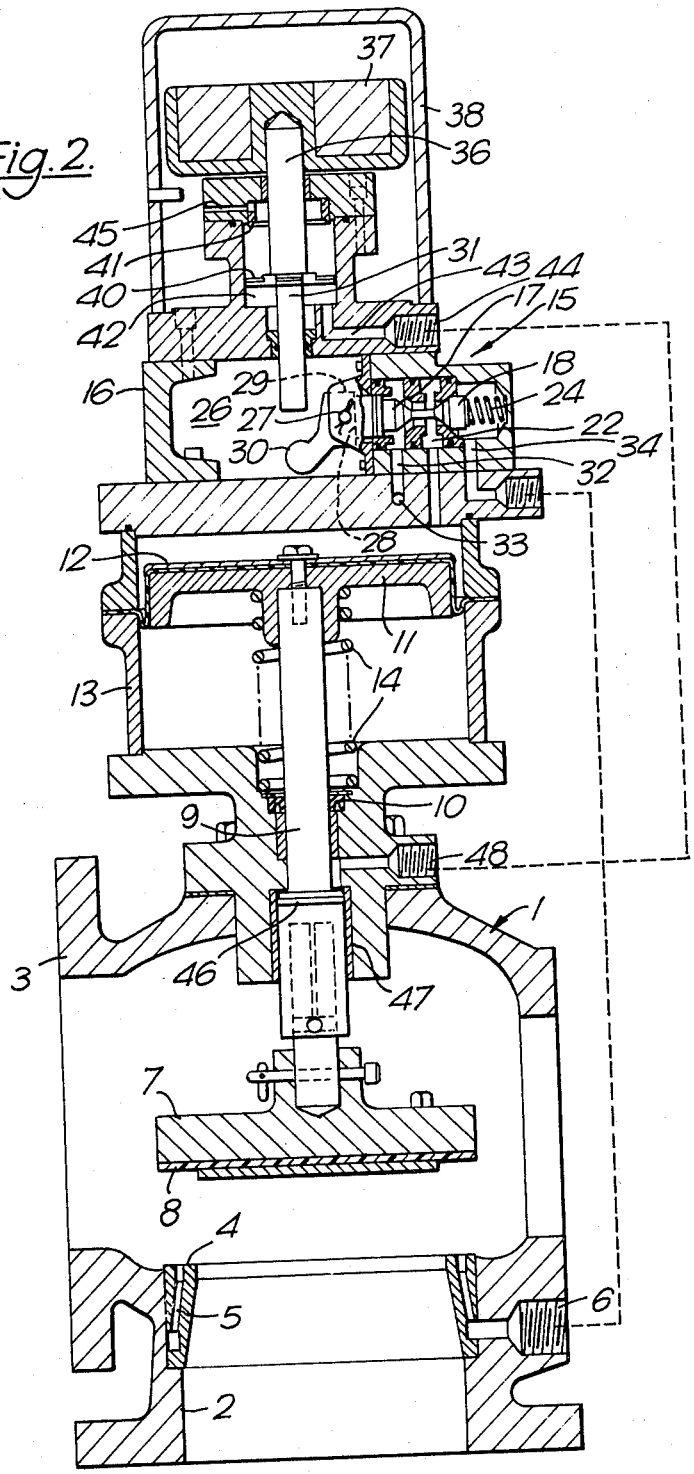

The invention will be further described, by way of example, with reference to the accompanying purely diagrammatic drawings, in which:

FIG. 1 is an axial cross section through a control valve and actuator device according to one embodiment of the invention, shown in its closed (inactive) position, and FIG. 2 shows the valve and actuator device of FIG. 1 in axial section, in its open condition.

The control valve and actuator device shown in the drawings includes a "wet valve" assembly comprising a housing 1 provided with a water inlet 2, a water outlet 3 and a flat annular valve seat 4 between the inlet 2 and outlet 3. In use of the device the water inlet 2 is connected to a mains water supply, typically at a pressure of 150 psi, and the water outlet 3 is connected to a pipe system (not shown) leading to a number of controlled sprinkler heads.

An annular groove 5 in the valve seat 4 communicates with an auxiliary outlet port 6 which in use of the device is connected to a water motor and alarm gong.

A circular disc-like clapper valve member 7 provided with a resilient sealing face 8 is maintained in sealing contact with the valve seat 4, covering the annular groove 5 by a push rod 9 which passes through a seal 10 in the valve housing 1, carrying at its end remote from the valve clapper member 7 a circular disc-like piston 11. In this closed position (FIG. 1) the valve clapper member 7 cuts off communication between the water inlet 2 and the outlets 3 and 6.

The piston 11 provides rigid support for a central part of a flexible diaphragm 12 the periphery of which is sealingly clamped between two parts of a cylinder 13 within which the piston 11 moves axially, with clearance from the internal surface of the cylinder 13. The amount of the diaphragm 12 between the piston 11 and the peripheral portion clamped by the cylinder 13 is such that the diaphragm 12 can "roll" on the internal surface of the cylinder 13 as the piston 11 moves within the cylinder, providing a moving seal between the piston and the cylinder walls. A helical spring 14 acts upon the piston 11 urging the latter in a valve-opening direction (upwards in FIG. 1).

A trip valve 15 is mounted in a bronze body 16 which surmounts the cylinder 13. The trip valve 15 comprises two sealing heads 17, 18 mounted upon a common spool which is displaceable longitudinally within a valve chamber having two frusto-conical seats 19, 20 spaced apart longitudinally of the valve chamber by a distance less than the distance between the two sealing heads 17, 18. An internal passage 21 in the valve body 16 and in the adjacent end of the cylinder 13 provides communication between the interior of the cylinder 13 and an annular groove 22 in the trip valve body 16 between the two seats 19, 20. The trip valve spool is connected to a piston 23 which slides sealingly within a bore in the valve body 16, the piston 23 being lightly loaded by a helical spring 24 engaging the valve head 18 into engagement with a trip cam 25 mounted in a cavity 26 in the valve body 16 for pivotal movement about a pivot pin 27 perpendicular to the axis of the piston 23.

The cam face 29 and operating arm 30 may be provided with rollers to reduce friction between the surfaces of contact of the plunger 31, the cam 25 and the piston 23.

The trip cam 25 is formed at one end with two flat faces 28, 29 between which an included obtuse angle, typically 93°, is defined. At its other end the trip cam 25 is formed with an operating arm 30 having a rounded end which is engaged by an actuator plunger 31 which projects into the cavity 26 in a direction parallel to the axis of the push rod 9.

The trip valve body 16 is provided with an internal passage 32 adjoining the valve seat 19 which communicates with an exhaust port 33, and is further provided with a passage 34 adjacent the valve seat 20 which communicates with a mains water inlet port 35.

The trip valve actuator rod 31 projects downwardly from an integral plunger 36 of larger diameter which supports at its upper end a deadweight 37 enclosed within a protective casing 38. The plunger 36 passes through a seal 39 and where it adjoins the actuator rod 31 the plunger 36 is formed with a radial flange 40 which seals against a downwardly projecting annular lip 41 of the seal 39. The chamber 42 communicates through a passage 43 with an air connection port 44. An exhaust passage 45 vents to atmosphere through the seal 39 and is cut off from the chamber 42 when the flange 40 engages the seal 39, as shown in FIG. 1.

The push rod 9 which carries the wet valve clapper member 7 has an enlarged portion at its lower end which is provided with a resilient O-ring 46. The O-ring 46 cooperates with a cylindrical bore 47 provided in a bronze bush surmounting the valve housing 1. An air connection port 48 communicates with the interior of the bore 37. When the valve clapper element 7 is seated upon the valve seat 4—that is, when the wet valve is closed—the O-ring 46 is spaced from the entry of the bore 47, allowing communication between the water outlet 3 and the air connection port 48.

The control valve and actuator device can be used in different types of sprinkler systems. Its use in a dry-pipe system will be described with reference to FIGS. 1 and 2. For this mode of use the main water inlet connection port 35 is connected to the mains water inlet 2 through an external pipe (not shown) and the air connection ports 43 and 48 are interconnected by an external air pipe (not shown).

In the "inactive" state of the device with the wet valve 7 closed (FIG. 1) the sprinkler pipes connected to the water outlet 3 are sealed from the mains water supply connected to the water inlet 2 by the closure of the clapper element 7 against the valve seat 8. The sprinkler system is charged with air at a pressure of approximately 15 psi, this air being supplied through the ports 48, 43 to the chamber 42. The air pressure in the chamber 42 is sufficient to maintain the flange 40 seated against the seal 39, holding the deadweight 37 in the lifted position shown in FIG. 1. In this position the trip cam face 29 engages the piston 23 of the trip valve 15, maintaining the valve head 17 sealed against the seat 19, and cutting off the exhaust port 33 from the passage 21, while at the same time affording communication between the interior of the cylinder 13 through the passages 21 and 34 and the port 35 with the mains water supply at the inlet 2.

It will be seen that the effective cross sectional area of the piston 11 is greater than the area of the valve clapper element 7 exposed to the water pressure at the inlet 2, and accordingly in this position the mains water pressure produces a nett downward force on the piston 11, maintaining the valve clapper element 7 in positive sealing engagement with the valve seat 4.

When a sprinkler head operates due to the detection of a fire, or as a result of accidental damage in the sprinkler system, the pressure in the sprinkler pipe system drops rapidly, and when this pressure reaches about 9 psi it is insufficient to maintain the deadweight 37 in its lifted position. The weight 37 accordingly descends, pushing the plunger 36 and the actuator rod 31 downwards and operating the trip valve arm 30 so as to cause the trip cam 25 to rotate into a second stable position (FIG. 2) in which its face 28 abuts the piston 23 of the trip valve 15. The piston 23 is maintained in abutment with the face 28 by the spring 24.

It will be seen that the cam face 28 is closer to the pivot pin 27 of the trip cam 25 than the cam face 29. Accordingly, when the cam 25 is tripped by the descent of the weight 37, some of the energy stored in the spring 24 is released, so that the cam 25 is positively maintained in its trip position, and cannot return to the initial position unless positively reset.

The movement of the piston 23 into engagement with the cam face 28 upon tripping movement of the cam 25 results in a displacement of the piston 23, and the valve spool 17, 18 under the influence of the spring 24, to the left as shown in the drawings, so that the valve head 18 seals against the valve seat 20, while the valve head 17 moves away from the valve seat 19. In this tripped condition of the trip valve 15 the interior of the cylinder 13 is connected through the passage 21, the valve seat 19 and the passage 32 to the exhaust port 33, while the mains water pressure is cut off from the cylinder 13 by the valve head 18. The water pressure in the cylinder 13 is accordingly exhausted, allowing the piston 11 to rise under the influence of the spring 14, assisted by the mains water pressure at the inlet 2, so that the valve clapper element 7 is lifted positively from its seat 4, admitting the mains water to the sprinkler system.

Upon lifting of the clapper valve element 7 from the valve seat 4 the O-ring 46 carried by the enlarged portion 45 of the push rod 9 enters the bore 47, sealing the latter from the water admitted to the outlet 3. Residual air in the bore 47 is exhausted to atmosphere through the ports 48, 43, the chamber 42 and the vent passage in the seal 39, now uncovered by the movement of the flange 40 away from the seal 39.

The lifting of the valve clapper element 7 from the valve seat 4 also uncovers the annular groove 5, admitting water under pressure to the alarm pipe 6 so as to operate the associated water motor and alarm gong, thereby giving an audible alarm to indicate that the sprinkler system has been activated.

Since the residual air pressure in the sprinkler system is very small (less than 9 psi) when the "wet valve" opens, the mains water is delivered rapidly to the sprinkler heads through the outlet 3, without any exhauster device being necessary to vent the air pressure.

After tripping of the device the trip valve 15 can be reset manually and the sprinkler system downstream of the outlet 2 recharged with air to the required pressure.

The illustrated device can be used as a multipurpose control valve in a dry-pipe sprinkler system of the kind described, or in an alternate wet and dry pipe system. In the later system the piping leading to the sprinkler heads downstream of the "wet valve" is charged with air, in the manner described above in relation to a dry-pipe system, during winter months, when there may be a risk of freezing occuring at the sprinkler heads. At other times of the year the sprinkler pipe system is charged with water under pressure and operates as a wet-pipe system.

The tripping of the device of the present invention can be controlled according to a "deluge" system, utilising a fast-acting valve (deluge valve) which is operated by heat detectors or heat-sensing sprinkler heads located at regions where intensive or fast-propagating fires are likely to occur. The control valve and actuator device can also be used in a so called "pre-action" system, utilising an independent array of heat or smoke detectors which are capable of responding to a fire before the sprinkler heads themselves, to allow water to flow into the sprinkler pipe network before the first sprinkler in the system operates, thereby greatly reducing the delay between operation of the sprinkler head or heads and the delivery of water to the heads.

In an alternative to the embodiment illustrated the clapper valve member 7 may be replaced by a hinged clack valve coupled through a suitable lost-motion mechanism with the valve operating piston 11.

I claim:

1. A sprinkler system control valve and actuator device comprising a water supply valve having a housing provided with a water inlet for connection to sprinkler heads and a valve seat with which a movable valve member cooperates, a valve actuator attached to the valve housing and operable by the pressure in the water inlet to maintain the valve member sealed against the valve seat cutting off the water inlet from the water outlet, and a trip valve operable when tripped to vent the water pressure from the actuator so as to allow the valve member to lift from the valve seat, and trip means operatively connected to the trip valve to trip the latter in response to a pneumatic signal, said trip means maintaining the trip valve in its tripped condition until manually reset, said valve actuator comprising a piston movable within and sealed relative to a cylinder, the piston having an effective surface area greater than the effective area of the valve member subjected to the water pressure when the valve member is sealed against its valve seat, thereby maintaining the water supply valve closed.

2. A device as in claim 1, wherein a rolling diaphragm seal is provided between the piston and the walls of the cylinder.

3. A device as in claim 1, in which the trip means includes a deadweight which is opposed by air pressure at the water outlet of the supply valve when the latter is closed, the said air pressure dropping sufficiently in response to the operation of a said sprinkler head connected to said outlet to cause the deadweight to operate the trip valve so as to cut off the water inlet pressure from the actuator and connect the actuator to a water drain or exhaust outlet.

4. A device as in claim 3, wherein the trip means further include a trip lever cooperating with the trip valve and having first and second stable positions, the lever being movable from the first stable position, in which the trip valve closes the drain or exhaust outlet and connects the actuator to the water inlet pressure, to the second stable position, in which the trip valve opens the drain or exhaust outlet and cuts off the water inlet pressure from the actuator, by a displaceable operating member moved by the deadweight upon said dropping of the air pressure.

5. A device as in claim 4, wherein the trip valve has a spring-loaded spool and the trip lever has two cam faces disposed at different distances from the pivot axis of the trip lever and engaged with the trip valve spool in said first and second stable positions.

6. A sprinkler system control valve and actuator device comprising a water supply valve having a housing provided with a water inlet for connection to a water supply, a water outlet for connection to sprinkler heads and a valve seat with which a movable valve member cooperates, a valve actuator attached to the valve housing and operable by the pressure in the water inlet to maintain the valve member sealed against the valve seat cutting off the water inlet from the water outlet, and a trip valve operable when tripped to vent the water pressure from the actuator so as to allow the valve member to lift from the valve seat, and trip means operatively connected to the trip valve to trip the latter in response to a pneumatic signal, said trip means maintaining the trip valve in its tripped condition until manually reset, said trip means including a trip lever cooperating with said trip valve and having first and second stable positions, and said trip valve having a spring-loaded spool and the trip lever having two cam faces disposed at different distances from the pivot axis of the trip lever and engaged with the trip valve spool in said first and second stable positions.

* * * * *